United States Patent [19]

Zeitlin

[11] Patent Number: 4,917,372

[45] Date of Patent: Apr. 17, 1990

[54] LIQUID-CONTAINING ILLUSORY DEVICE

[76] Inventor: Eric S. Zeitlin, 3059 Grand Ave., Baldwin, N.Y. 11510

[21] Appl. No.: 293,079

[22] Filed: Jan. 3, 1989

[51] Int. Cl.[4] ..... A41D 1/00

[52] U.S. Cl. ..... 272/8 N; 434/262; 434/268; 2/25; 446/267

[58] Field of Search ..... 2/2, 1, 2.5, 69, 102; 272/1 R, 8 R, 8 N, 8 D; 434/262, 266, 268, 267; 446/267

[56] References Cited

U.S. PATENT DOCUMENTS

| | | | |
|---|---|---|---|
| 4,453,271 | 6/1984 | Donzis | 2/2.5 X |
| 4,531,919 | 7/1985 | Ware | 434/262 |
| 4,601,067 | 7/1986 | Buonassissi | 2/102 |

FOREIGN PATENT DOCUMENTS

| | | | |
|---|---|---|---|
| 323347 | 7/1957 | Switzerland | 434/268 |

*Primary Examiner*—Richard E. Chilcot, Jr.

[57] ABSTRACT

An illusory device for use in conjunction with protective garments, comprising of one or more sheets of fluid impervious material in flatwise registering relationship and being mutually secured in their marginal zones for jointly defining a central chamber, and with there being a liquid of predetermined coloration and composition partially or completely filling the central chamber for exception through the walls of the device. The device is worn by itself or secured to one or more other illusory devices, which is subsequently secured to or placed over the selected protective garment by securing means.

8 Claims, 2 Drawing Sheets

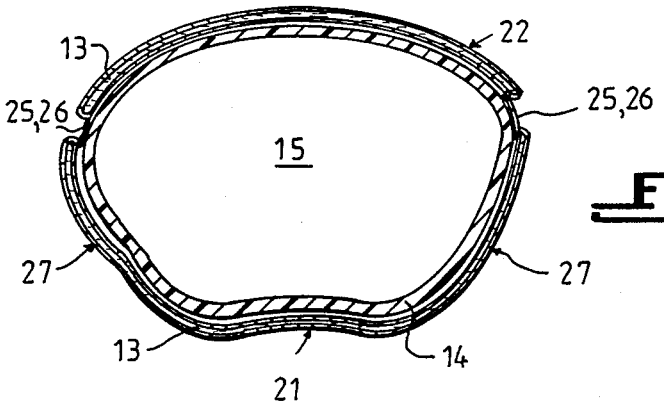
Fig. 3
Fig. 4
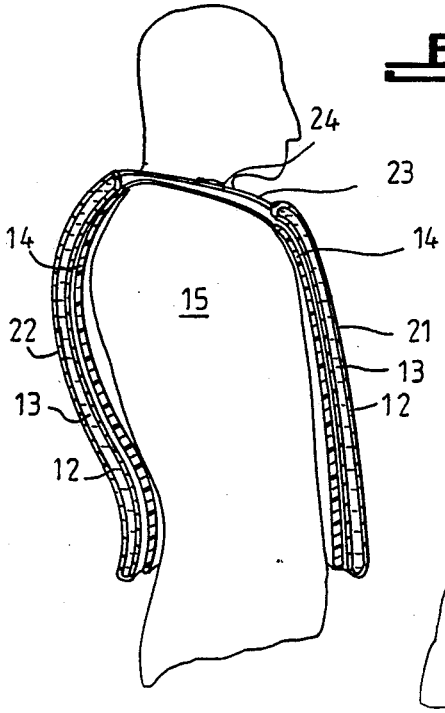
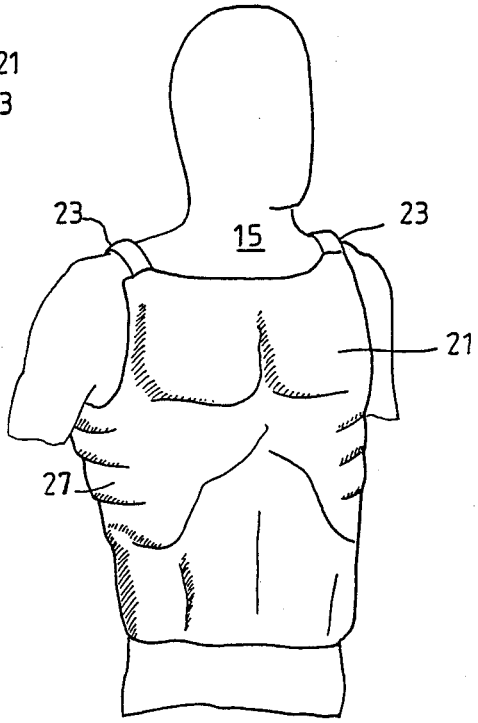
Fig. 5

LIQUID-CONTAINING ILLUSORY DEVICE

BACKGROUND OF THE INVENTION

1. Field of Invention

This invention relates broadly to wearing apparel, and more specifically to a liquid containing illusory device to be worn over an article of protective clothing or protective garment for purposes of creating an illusion of said illusory device's wearer's skin being punctured.

2. Discussion of Prior Art

One method that is currently used by actors which creates the illusion of skin puncture, more specifically that of skin being punctured by a bullet, is a method using what is commonly referred to as a "squib". Said method refers to the placing of one or more limited, outwardly facing explosive device consisting of manually placed explosive material in small tubes, said explosive material being placed inside an actors wearing apparel facing away from said actors body. Said explosive material is subsequently triggered by a second person, said second person igniting said explosives by electrical means, causing a hole in said actors wearing apparel, creating an illusion of said actors being have been shot by a bullet. Said squib can only be implemented by one having a license to implement squibbs.

Another method of providing said illusion is to place red powder into an air gun and subsequently fire said airgun at the target desiring said illusion.

Niether of these methods, being the only two I could find, deal with creating said illusion for the purpose of promoting the safety of the user.

The McGee patent; U.S. Pat. No. 4,631,210, discloses a liquid containing decorative device which is the closest appearing invention I could find. I sufficiently believe my invention to be different enough from this patent.

Hence, the prior art is devoid of the provisions of a closed, pocket forming illusory device which carries a predetermined amount of liquid therein for the purpose of creating the illuson of a skin puncture after said illusory device has been punctured, releasing said liquid onto the area outside of said illusory device.

SUMMARY

Operation

The operation of the Liquid Containing Illusory Device is simple; its main purpose is, in fact, to be broken. The Liquid Containing Illusory Device is designed to be punctured by an attacking weapon, for example a bullet, thus releasing the fluid contained within said Liquid Containing Illusory Device out onto the outside of said Liquid Containing Illusory Device and the wearers clothes, as well as into the air. If the fluid is red and sufficiantly made to appear as blood, said fluid is designed to provide the illusion that it is in fact the Liquid Containing Illusory Device wearer's own blood; in other words, the Liquid Containing Illusory Device is designed to provide the illusion that the wearer's own skin has been punctured and the fluid that appears is the wearer's own blood. Since the Liquid Containing Illusory Device is designed to go over a protective garment, however, the wearer's skin should thus be protected by said protective garment from said bullet.

The intended purpose of the illusion desired, that of a puncture of the wearer's skin when in fact it hasn't been punctured, is to preclude any further attack upon the wearer. In other words, if the Liquid Containing Illusory Device/protective clothing wearer is shot, it will appear to his attacker that said Liquid Containing Illusory Device wearer has been wounded, thus precluding any further attack against said Liquid Containing Illusory Device wearer. What I truly wish my invention to do is to save the lives of Police Officers and other law enforcement officials who wear bulletproof vests.

I will thus describe each part's operation:

Liquid Containing Illusory Device's (21 and 22) are designed to cover the front and back of the protective garment. The rearward extensions (27) are designed to cover the sides of the protective garment.

Elastic straps (25 and 26) are designed to keep the two Liquid Containing Illusory Device's (21 and 22) and rearward extensions (27) close against the protective garment, yet still providing some "give" to allow movement and a good fit.

Shoulder straps (23) and adjustible buckles (24) are designed to achieve a comfortable and close fitting fit for the wearer, as well as to position the two Liquid Containing Illusory Devices in a position to achieve maximum effectiveness and realism based on the wearers height and body shape.

The walls of the Liquid Containing Illusory Device (13) are designed to look as life-like as possible, in shape and/or color and/or texture. Said walls (13) are also designed to be strong enough to withstand any situation when normally blood would not be drawn from the wearer if he wasn't wearing any protective clothing or Liquid Containing Illusory Device, yet weak enough to be able to be punctured by any attacking object that would normally puncture the skin of the wearer if he was not wearing any protective clothing or Liquid Containing Illusory Device. Said walls (13) will also provide a slight extra stopping power to attacking objects which will provide an extra measure of safety. The intended shape and appearence of the outer walls (13) of said Liquid Containing Illusory Device, as that of the body part being covered, is also intended to provide a "camouflage" of the protective garment: said walls covering the protective garment providing the Liquid Containing Illusory Device wearer with the appearence that he is not wearing any protective garment at all.

The liquid (12) contained therein said Liquid Containing Illusory Device is designed to look like the Liquid Containing Illusory Device wearers blood in order to provide the illusion that it is, in fact, the Liquid Containing Illusory Device wearer's blood. Said liquid (12) is designed to be discharged from the Liquid Containing Illusory Device into view of the attacker. The liquid (12) contains alcohol for two basic reasons: The first is to provide an anti-freeze agent in order to preclude any freezing of said liquid, and thus precluding the destruction of the Liquid Containing Illusory Device resulting from the freezing of said liquid. The second reason is to provide a harmless anti-freeze in case the attacking object punctures the Liquid Containing Illusory Device wearers protective clothing and then the Liquid Containing Illusory Device wearers real skin. This function is served further if the following are considered: If the alcohol previously mentioned (Isopropyl or Glycerol) is in a non-human harming form, it will also help to cleanse and disinfect the resulting wound, said alcohol will also cleanse and disinfect the attacking object, thus decreasing the chance of infection to the Liquid Containing Illusory Device wearer, and said alcohol will help to decrease the heat content of any attacking object, thus decreasing the effects of a hot object entering the Liquid Containing Illusory Device wearer's body (i.e.; burns). Other chemicals or medicines can be added to said liquid in order to facilitate the minimization of any bodily harm to the Liquid Containing Illusory Device wearer, in case the attacking object does puncture the Liquid Containing Illusory Device wearers skin.

While the above description contains many specificities, these should not be construed as limitations on the scope of the invention, but rather as an exemplification of one preferred embodiment thereof. Many other variations are possible, for example, those encompassing any of the ramifications below. Accordingly, the scope of the invention should be determined not by the embodiment illustrated, but by the appended claims and their legal equivalents.

Possible ramifications of my invention:

(a) The illusory device can be filled with any substance, having any form, substance, consistancy and/or color.

(b) The illusory device can be made of any substance, obviously limited to fluid impervious material which will allow the penetration of an attacking object. For example, but not limited to, the illusory device can be made of plástic, molded by a method referred to as vaccuum forming. The illusory device would be, for example, be made in two parts, front and back of each illusory device, which is then filled with liquid, which may be vaccuum packed if desired, said front and back of each illusory device then heat-sealed together to form an airtight seal.

Types of plastic that may be used, for example, are Styrene and PVC.

(c) The hollow chamber formed by the walls of the illusory device can be filled partially or completely, but a completely filled chamber is desirable in order to facilitate the displacement of fluid by the attacking object of the illusory device.

(d) The illusory device can be used by humans and animals.

(e) The illusory device can be used without protective clothes underneath.

(f) The illusory device can be made in different sizes and proportions.

(g) The illusory device can be made in any shape.

(h). The illusory device walls can be of any thickness ("derometer").

(i) The illusory device itself can be of any thickness.

(j) The illusory device can be made in separate pieces of any size, each self-enclosed, secured to one another. This will facilitate easier and more cost-efficient replacement of single parts of the illusory device, as well as, perhaps a more flexible and realistic look.

(k) The illusory device can contain self-enclosed compartments contained inside said illusory device.

If ramifications J or K exist in the illusory device, said illusory device may be more effective that a single, one-piece illusory single-chambered illusory device, for example if more than one bullet is fired at the wearer. This greater effectiveness may come from a preservation of fluid in the chambers not punctured, in order to allow them to be usable against a second or continuing attack.

(l) The illusory device can be permanently or temporarily secured directly to the protective garment by means of securing means. i.e. snaps or buttons.

(m) The illusory device can be permanently or temporarily secured to an article of clothing by means of securing means. i.e. snaps, buttons, zippers, etc.

(n) The illusory device can be used with any type of protective garment.

(o) The illusory device can be painted or colored otherwise any color; for example the color of the wearer's skin, using a waterproof, permanent coloring which won't affect the property of rubber; for example, enamel paint.

(p) The illusory device can have objects secured to it; for example comercially available artificial hair, by means of, for example, glue.

(q) The illusory device can be molded and colored to appear like articles of clothing.

(r) The illusory device can be made with "pillars" inside of said illusory device, which can be molded into the illusory device.

(s) The illusory device can be used by itself or with other illusory devices, which may or may not be secured to each other by any securing means, said securing means including, for example, a flexible nonelastic strap molded into said illusory device.

(t) The illusory device can be made with plastic and subsequently covered in rubber or other substances, for example, but not limited to, latex, which can be molded onto the outside of said plastic illusory device.

(u) The illusory device can be used for illusory purposes otherwise; for example by actors wishing to portray a realistic-looking attack.

Objects:

Accordingly, it is an object of the present invention to provide a more realistic illusion by providing the following:

(a) A more silent illusion, since no exploding devices are used.

(b) If the illusory device is shaped like the body part being covered by it, said illusory device provides a "camouflage" to the article of protective apparel being worn beneath said illusory device, by providing a "life-like" look to said protective apparel through means of the shape of said body part.

(c) Said illusory device provides further camouflage to said protective apparel if said illusory device is made to appear being colored the same color as the wearer's skin, and including, but not limited to, such items as commercially available artificial hair secured to said illusory device in areas where hair usually grows on the the body part said illusory device is shaped to look like and is being covered by said illusory device. Said camouflage occurs if no outer wearing apparel is worn covering said illusory device and said protective apparel.

(d) The illusion of a skin puncture at the exact point of impact of the attacking object, instead of the preplaced illusory point of impact, which may not be where the attacking object has actually hit the wearer.

(e) Further realism if said illusory device is shaped and/or colored to appear as wearing apparel, possibly including but not limited to such items as buttons and pockets.

(f) If rubber is used to make the outer walls of the illusory device, a more life-like feel is accomplished if said illusory device is touched by someone.

It is another object of the present invention to provide better operation as such:

(a) The illusory device works without the need of a second person or other collaborator.

(b) Said illusory device works without the need to be triggered manually, leaving the wearer more time to react to said wearer's attacker.

(c) Said illusory device can be used at anytime without the need for prior knowledge of when it will be used.

(d) Said illusory device can be used anywhere without the need for prior knowledge of where it will be used.

(e) Said illusory device can be used by anyone wearing said illusory device, without the need for training said wearer in said illusory device use, and without the need for a license to use or wear said illusory device.

(f) Said illusory device can be used for purposes of providing more versatility to the user, since it can be used to provide a skin puncture illusion when any attacking weapon is used, for example but not limited to a knife or arrow.

(g) Said illusory device is more durable than, for example, a "Squib", since it well be able to withstand expected elements the wearer of a protective garment might experience, for example but not limited to rain or other wetness and physical exertion, which a "squib" would not be expected to withstand.

(h) Said illusory device is quicker to replace on said wearer of said illusory device, since it is made ready to use and needs only to be put on by the said wearer, needing no extra manipulation in order to attain said illusory device readiness for its intended function.

(i) Said illusory device is more reliable, since it has less parts and moving parts than, for example but not limited to, a "Squib".

It is a further object of the present invention to provide better marketability as such:

(a) Said illusory device can be produced in an economical and rapid fashion without prejudice to the integerity of the structure of said illusory device, thus enabling said illusory device to reach economies of scale in production.

(b) No licenses or training is required for use of said illusory device, thus saving the costs for said licensing and training being purchased.

(c) Said illusory device's before mentioned greater reliability will decrease the need for repalcement of said illusory device because of functional malfunction, thus saving the purchaser the cost of any replacement of said illusory device for reason of its functional malfunction.

(d) Said illusory device can be sold without regulations by a government agency such as any said government agency that deals with the sale of explosive devices.

(e) Said illusory device can be custom-made to the exact specifications of the wearer of said illusory device, for example but not limited to the wearer's hair color, skin color, and body size.

It is another objective of the present invention to provide better safety as such:

(a) The safety of the wearer of said illusory device is preserved since no explosive nor electrical means are needed for the use of said illusory device, thus eliminating all hazards related to the use of explosive and electrical means.

It is another object of the present invention to provide better preservation of the earth's atmosphere as such:

(a) Since no burning takes place in said illusory device, no pollutants usually related to burning are released into the earth's atmosphere, thus eliminating any pollution related to incineration and explosions.

It is another object of the present invention to provide better use as such:

(a) When said illusory device is punctured by an attacking object, the liquid outflowing from said puncture giving the attacker of the wearer of said illusory device the illusion that the said wearer's skin has been punctured, thus providing said wearer an extra measure of protection against said attacker, by reason that the said attacker will be under the illusion that said illusory device wearer has been wounded by said attackers said attack.

(b) Said illusory device will provide resistance to any attacking means, although not enough to preclude the entering of said attacking means into the wearer of said illusory device but providing more protection than if only the initial said protective garment is being worn.

(c) Said illusory device being quick and easy to don or doff.

(d) Said illusory device, if made to look like the body part said illusory device is covering, for example but not limited to in color and shape, need not be covered by wearing apparel in order to conceal said illusory device, since said illusory device will appear to be part of the wearer of said illusory device's own body.

(e) The liquid contained therein said illusory device will serve to decrease the temperature of any attacking object, for example but not limited to a bullet, thus decreasing the likelihood of any damage usually related to a hot bullet caused to a human being, in case said bullet is not stopped by the article of protective apparel being worn underneath said illusory device; if alcohol is contained in said liquid, said alcohol will serve to disinfect said attacking object, therby decreasing the likelihood of infection of any subsequent skin puncture to the wearer of said illusory device, under said circumstances of said bullet not being stopped by the protective garment worn underneath said illusory device.

BRIEF DESCRIPTION OF THE DRAWINGS (a) FIG. I is a perspective view of my invention, with a view of the parts of each Liquid-Containing Illusory Device which are designed to face outward, away from the body of the wearer.

(b) FIG. II is a cross section of the two connecting Liquid-Containing Illusory Devices, indicated by the section lines 16—16 in FIG. I, looking down onto the wearer.

(c) FIG. III is a cross section of the front Liquid-Containing Illusory Device (21) indicated by the section line 17—17 in FIG. II, looking at the wearer from his right side.

(d) FIG. IV is also a cross section at line 16, but including a cross section of a protective garment underneath the Liquid-Containing Illusory Device, and a cross section of the wearer's body underneath the protective garment.

(e) FIG. V is a front right side view of the Liquid-Containing Illusory Device and Liquid-Containing Illusory Device wearer; note that no protective garment is being worn for the sake of clarity of the drawing.

DESCRIPTION OF THE PREFERRED EMBODIMENT

Figure 1:
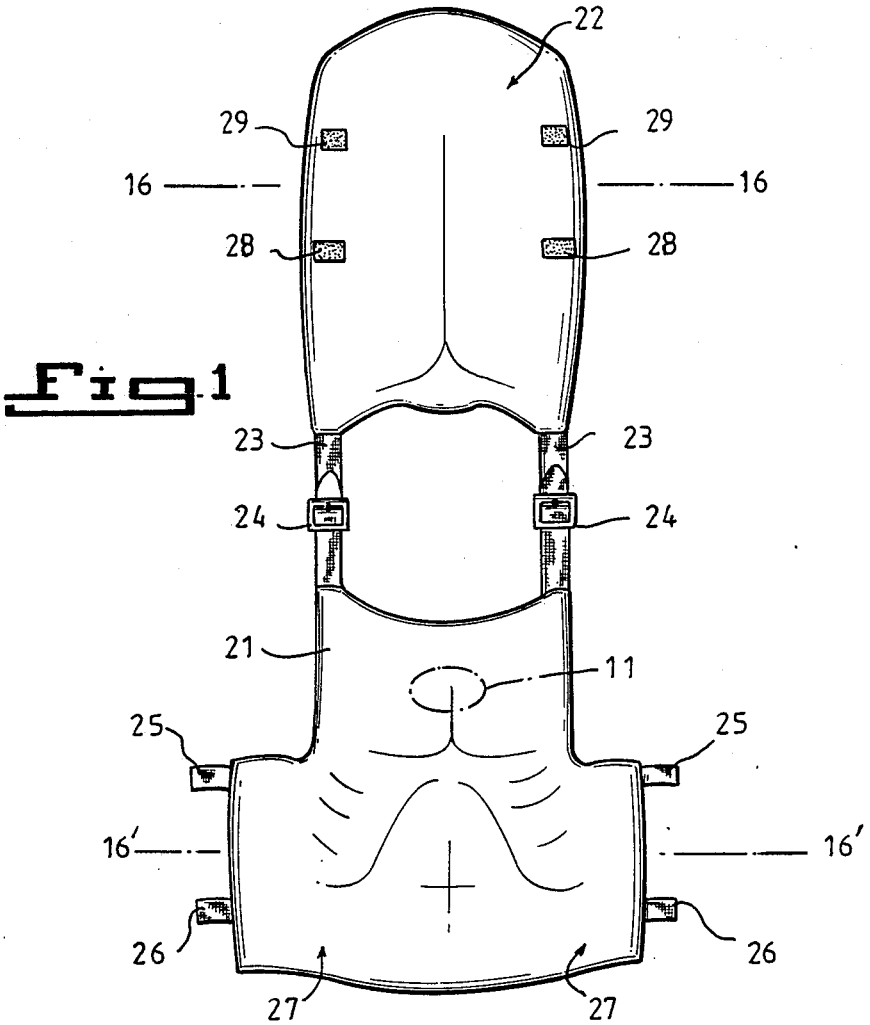
Figure 2:
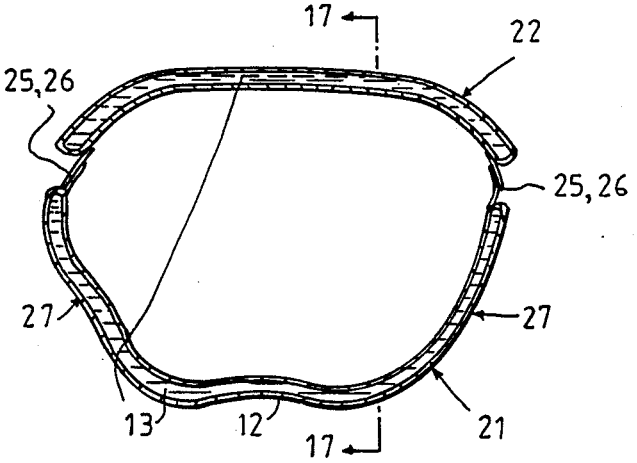

My invention, the Liquid Containing Illusory Device, is shown here in FIGS. I–V in one of it's possible forms: my preferred embodiment. In FIG. I, two Liquid Containing Illusory Devices (21 and 22) which are made of rubber, are connected by two shoulder straps (23) made of strong but very flexible material with adjustable buckles (24) which are secured to each Liquid Containing Illusory Device by securing means such as molding or glue, and also being connected by four strips of elastic material (25 and 26) which are secured at the edge of the rearward extensions (27) on the inside (section not visible) and end on the inside section of the rear Liquid Containing Illusory Device (22) at points 28 and 29, preferably well inside the edge. A section of the front of the front Liquid Containing Illusory Device (21) contains a section (11), shown here only as an example, of where commercially available artificial hair may be secured to said Liquid Containing Illusory Device in order to achieve a more lifelike appearance. The object shown in FIG. I is designed to be worn over a protective garment such as the one shown in U.S. Pat. No. 3,973,275. The front of the front illusory device (21) (shown in FIG. I) and the front of the back illusory device (22) (shown in FIG. I) are designed to be worn facing out, away from the wearer. Front illusory device's (21) front is molded to look like the part of the body that it is covering, in this case a male torso, as is the front of the back illusory device (22). The back sections of both the front and back illusory devices are designed to be molded to be in the shape of the outside surface of the bulletproof or protective garment, in order to facilitate a close fit and more lifelike appearance.

Rearward extensions (27) are designed to cover the sides of the wearer, around the ribcage, held in place by elastic strips (25 and 26), said strips allowing movement by the wearer and facilitating different sizes of wearer's bodies. The adjustable shoulder straps (23) will also help to achieve this goal.

FIG. II shows a cross section of the two connected illusory devices, cut at line 16—16 in FIG. I. In FIG. II I have also shown the outer walls of the illusory device (13) and the fluid contained therein (12).

FIG. III shows the same view as FIG. II except that here I have included a cross section of the protective clothing being worn underneath the illusory device (14) as well as a cross section of the wearer (15).

FIG. IV shows a side view of the illusory devices (21 and 22), the protective garment (14), and the wearer (15) all cut at line 17—17 of FIG. II. In this view I hope to show further the illusory devices position and function in regard to the wearer and the protective garment that said illusory devices are covering.

FIG. V shows the illusory devices being worn by a wearer (15) without a protective garment worn underneath it, in hopes of further providing understanding of my invention.

The preferred embodiment of my invention is described following as being made of rubber, but can be made of any substance that is fluid impervious and allows penetration of an attacking object.

By means of injection molding, a one piece hollow structure is created of rubber, in this case alcohol resistant rubber, leaving a spout at the top to allow liquid to be poured within said structure, said seal to be subsequently sealed in order to make said structure airtight. Said structure can also be made sealed initially without said spout, afterwhich said fluid may be injected into said structure by means of an injecting needle.

The liquid contained within the illusory device is made, in this case, with water, red and blue coloring or food dye, a thickening agent such as corn starch or flour, and an anti-freezing agent, in this case Isopropyl or Glycerol alcohol.

The shoulder straps are made of strong but very flexible material, with, in this case, adjustable buckles, but any securing means may be used, for example but not limited to buttons, snaps, zippers or the like, which can be glued onto the illusory device, or can also be molded into the illusory device itself, or by other securing means.

The side strips are, in this example, made of elastic material, but can be replaced by other securing means, for example but not limited to, cooperating strips of fastening material (hook and pile) such as that marketed under the trade name VELCRO, such securing means replacing or used with the strips of elastic material (25 and 26 in the drawings).

INDEX TO SYMBOLS

11—Area where commercially available artificial hair might be placed
12—Liquid contained within illusory device
13—Outside walls of illusory device
14—Protective garment
15—Body of wearer
16—16—Line cut for FIG. II
17—17—Line cut for FIG. III
21—Front illusory device
22—Back illusory device
23—shoulder strap
24—Adjustable buckle
25—elastic strip
26—elastic strip
27—Rearward extension
28—Connection point for 25
29—Connection point for 26

I claim:

1. An illusion device for use with a protective garment; said device comprising a first sheet of fluid impervious material and a second sheet of fluid impervious material; and wherein at least on of said sheets of material is shaped to resemble the outer contour of a human body part; and said first and second sheets are joined at their marginal edges, thereby forming at least one central fluid chamber; and said device further comprises a fluid contained within said central fluid chamber.

2. An illusion device as defined in claim 1, wherein said first and second sheets are flesh color.

3. An illusion device as defined in claim 1, wherein said liquid contains an antifreeze agent.

4. An illusion device as defined in claim 1, wherein said liquid contains a medicinal agent.

5. An illusion device as defined in claim 1, wherein said liquid contains a thickening agent.

6. An illusion device as defined in claim 1, wherein a plurality of support means are disposed between the first and second sheets.

7. An illusion device as defined in claim 1, wherein said illusion device having at least one additional illusion device connected thereto.

8. An illusion device as defined in claim 1, wherein said device comprises securing means for attaching the illusion device to said protective garment.

* * * * *